US006776609B1

(12) United States Patent
Sullivan et al.

(10) Patent No.: US 6,776,609 B1
(45) Date of Patent: Aug. 17, 2004

(54) APPARATUS AND METHOD OF OPERATION FOR BURNERS THAT USE FLUE GAS RECIRCULATION (FGR)

(75) Inventors: John D. Sullivan, Fremont, CA (US); Luis H. Morales, San Jose, CA (US); Robert W. Nickeson, Pleasanton, CA (US)

(73) Assignee: Alzeta Corporation, Santa Clara, CA (US)

( * ) Notice: Subject to any disclaimer, the term of this patent is extended or adjusted under 35 U.S.C. 154(b) by 0 days.

(21) Appl. No.: 10/606,559

(22) Filed: Jun. 26, 2003

(51) Int. Cl.[7] ..... F23M 3/00

(52) U.S. Cl. ..... 431/9; 431/12; 431/115; 431/116

(58) Field of Search ..... 431/9, 8, 115, 431/116, 12, 5, 181, 351, 354

(56) References Cited

U.S. PATENT DOCUMENTS

| | | | | |
|---|---|---|---|---|
| 4,659,305 A | | 4/1987 | Nelson et al. | 431/9 |
| 4,926,765 A | * | 5/1990 | Dreizler et al. | 110/234 |
| 4,995,807 A | * | 2/1991 | Rampley et al. | 431/9 |
| 5,040,470 A | | 8/1991 | Lofton et al. | 110/234 |
| 5,275,554 A | * | 1/1994 | Faulkner | 431/115 |
| 5,511,971 A | * | 4/1996 | Benz et al. | 431/9 |
| 6,039,560 A | * | 3/2000 | Kubota | 431/9 |
| 6,247,917 B1 | | 6/2001 | Berger et al. | 431/9 |

OTHER PUBLICATIONS

U.S. patent application Ser. No. 10/423,680, Apr. 25, 2003. John D Sullivan, et al.

U.S. patent application Ser. No. 10/423,680, Apr. 25, 2003, John D Sullivan, et al.

* cited by examiner

*Primary Examiner*—James C. Yeung
(74) *Attorney, Agent, or Firm*—Peters, Verny, Jones & Schmitt, L.L.P.; Howard M. Peters

(57) ABSTRACT

The present invention is a method and apparatus to improve the utilization of flow and power characteristics of a combustion air fan over the full range of burner operation. More specifically, it is an apparatus and a method of operation that uses a high flue-gas-to-air ratio over most of the boiler operating range to maximize thermal efficiency, but which switches to a lower ratio of flue-gas-to-air, or no flue gas in the limiting case, at the high end of the mass flow range of the burner to minimize the size of the fan housing and fan motor. When applied to current generation ULNBs, fan size can be reduced about 50% and operating power consumption can be reduced by about 50% without adversely affecting $NO_x$ emissions.

23 Claims, 8 Drawing Sheets

E(iii)

E(ii)

E(i)

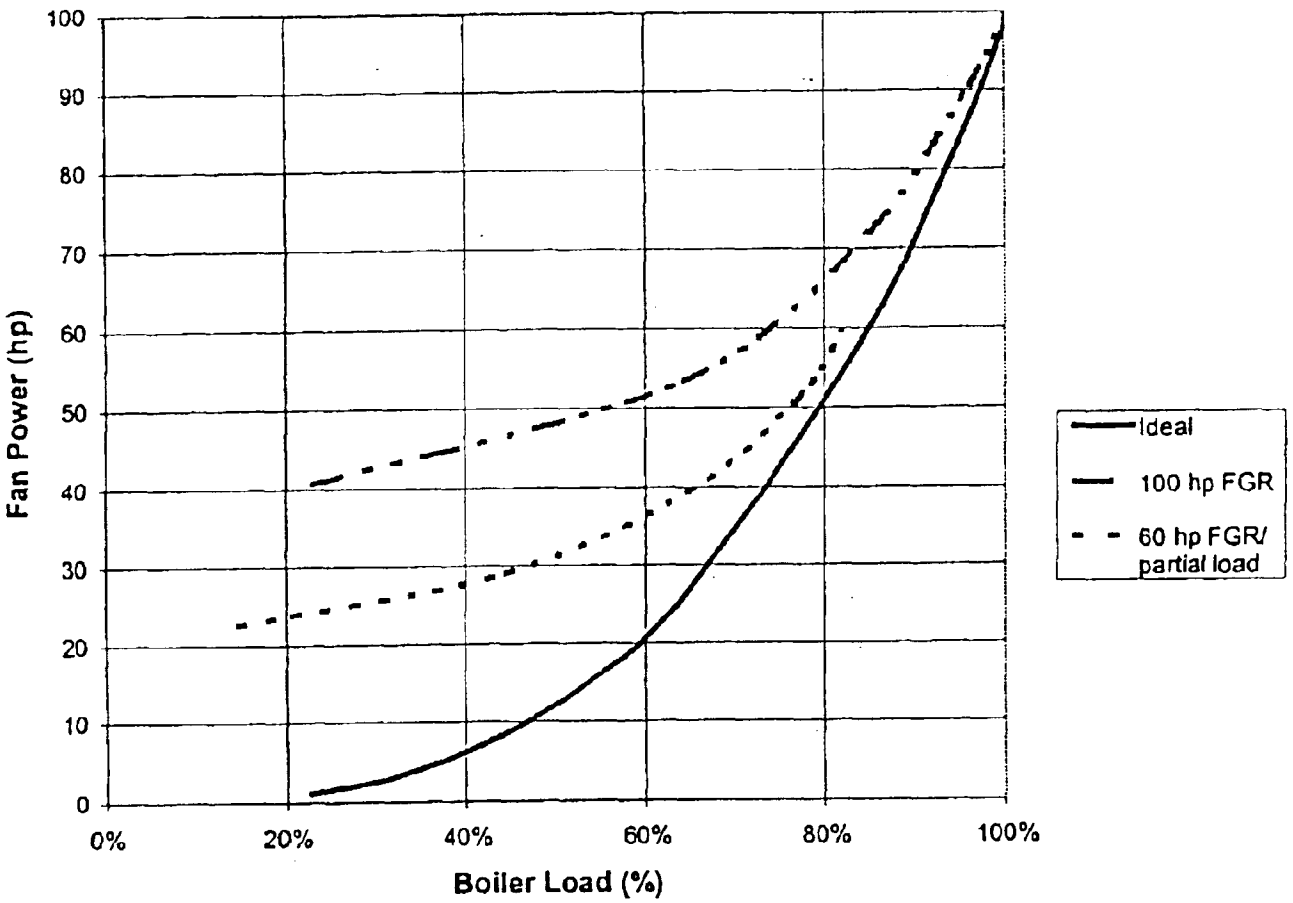
Figure 3. Comparison of Power Requirements of 60 and 100 hp Fans at Similar Operating Conditions

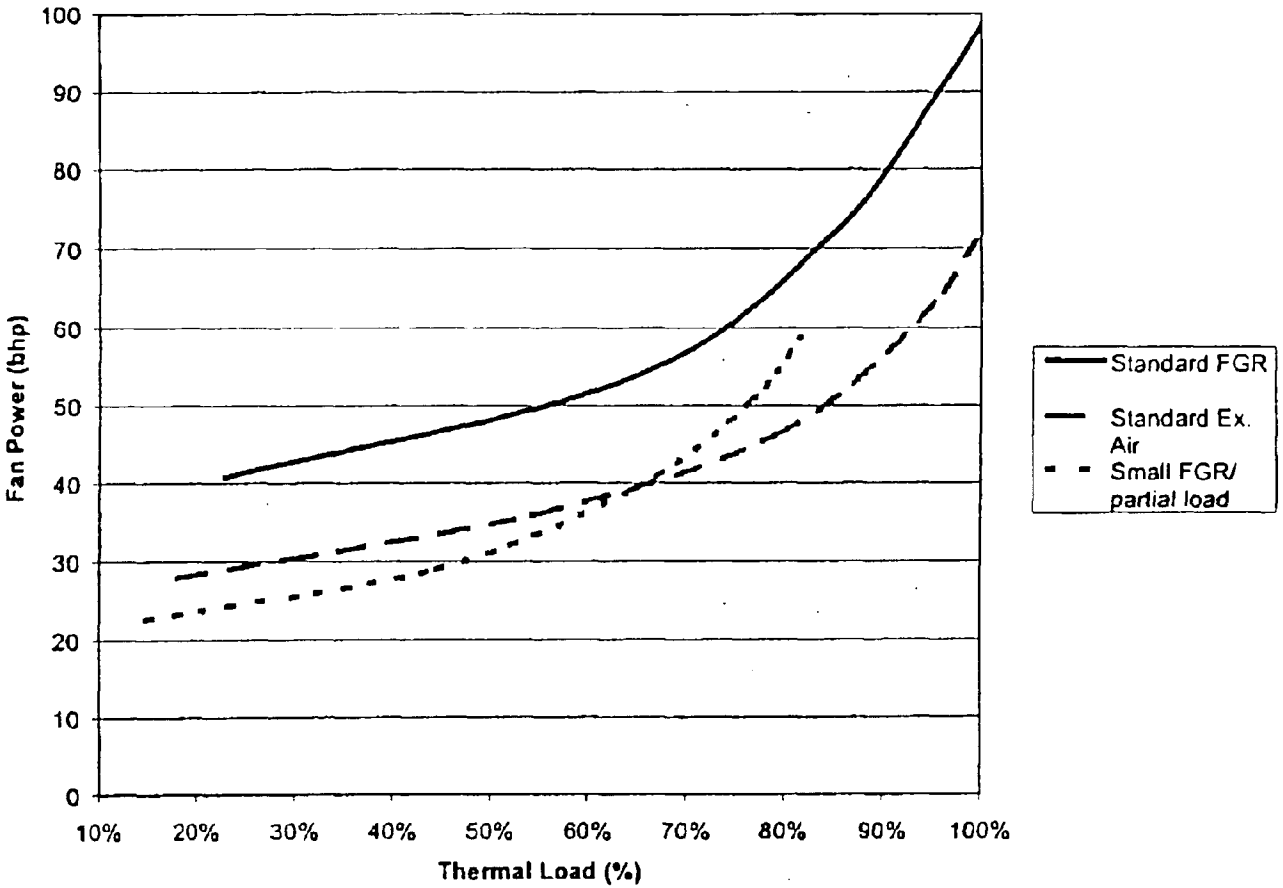
Figure 4. Comparison of Performance of Fan and Motor Combinations

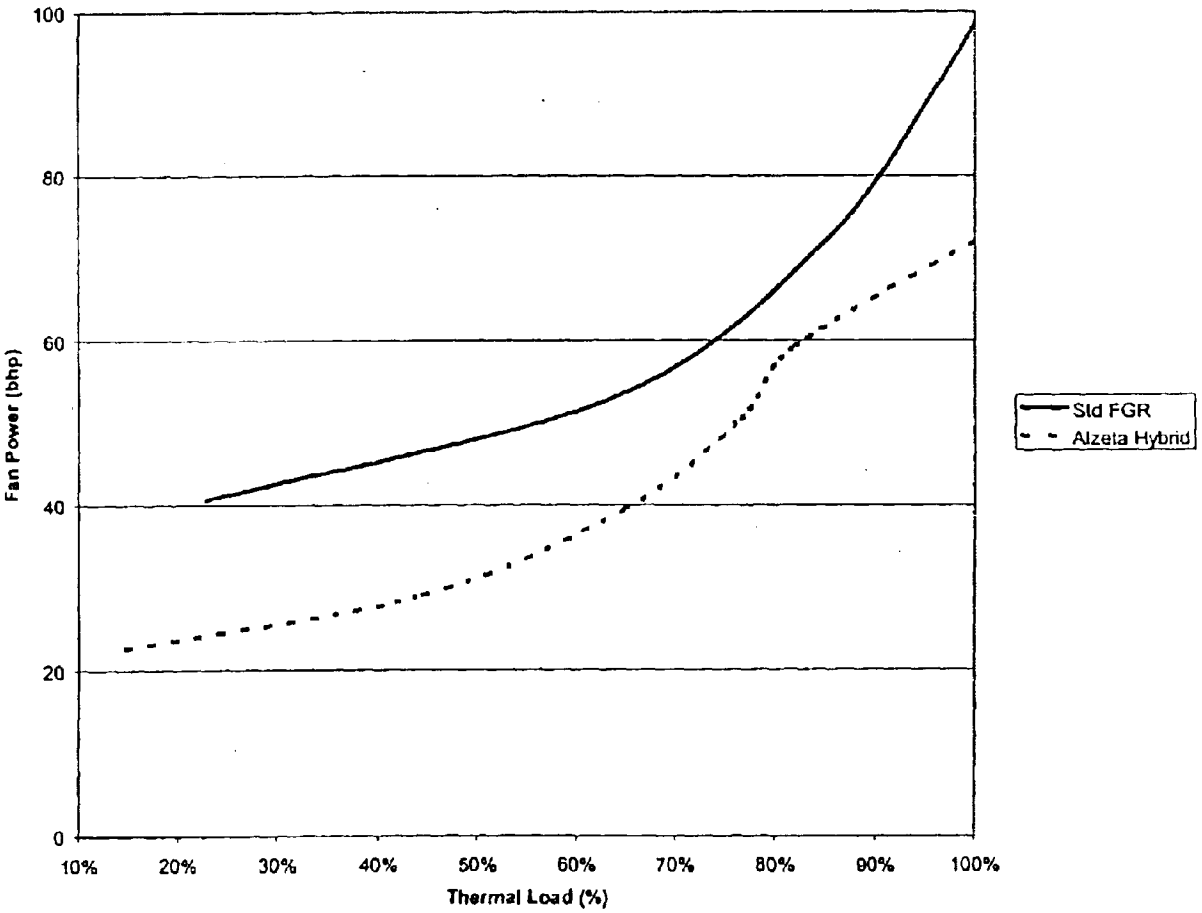
Figure 5. Comparison of Current ULNB Fan with Invention

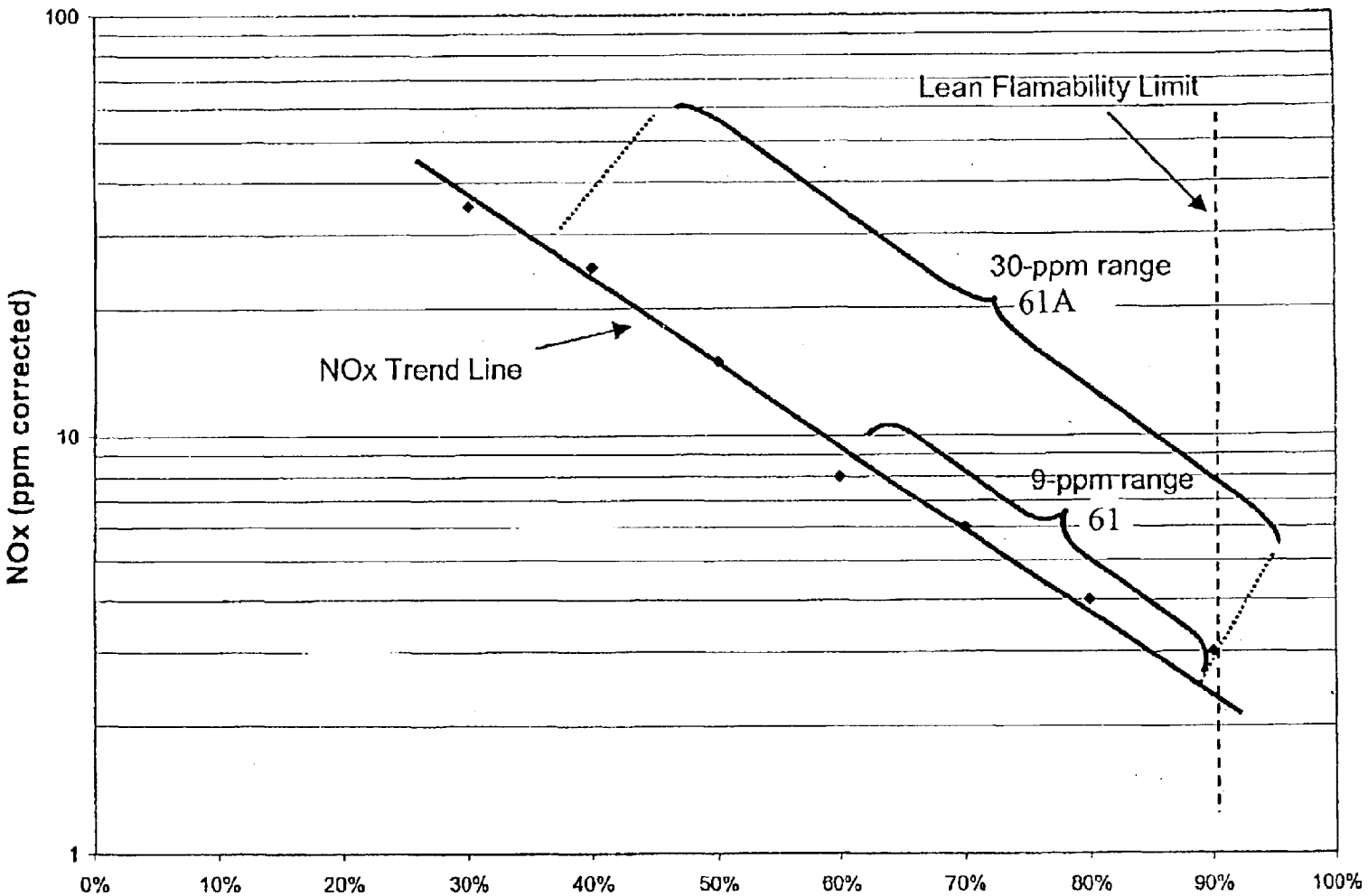
Figure 6. Excess Mass of Air and Flue Gas Mixture (Diluent) Relative to Stoichimetric Air. Controlling the Diluent Level is Critical in Controlling NOx Emissions and Maintaining Flame Stability Figure 7. Typical Air and FGR Levels Used by Invention
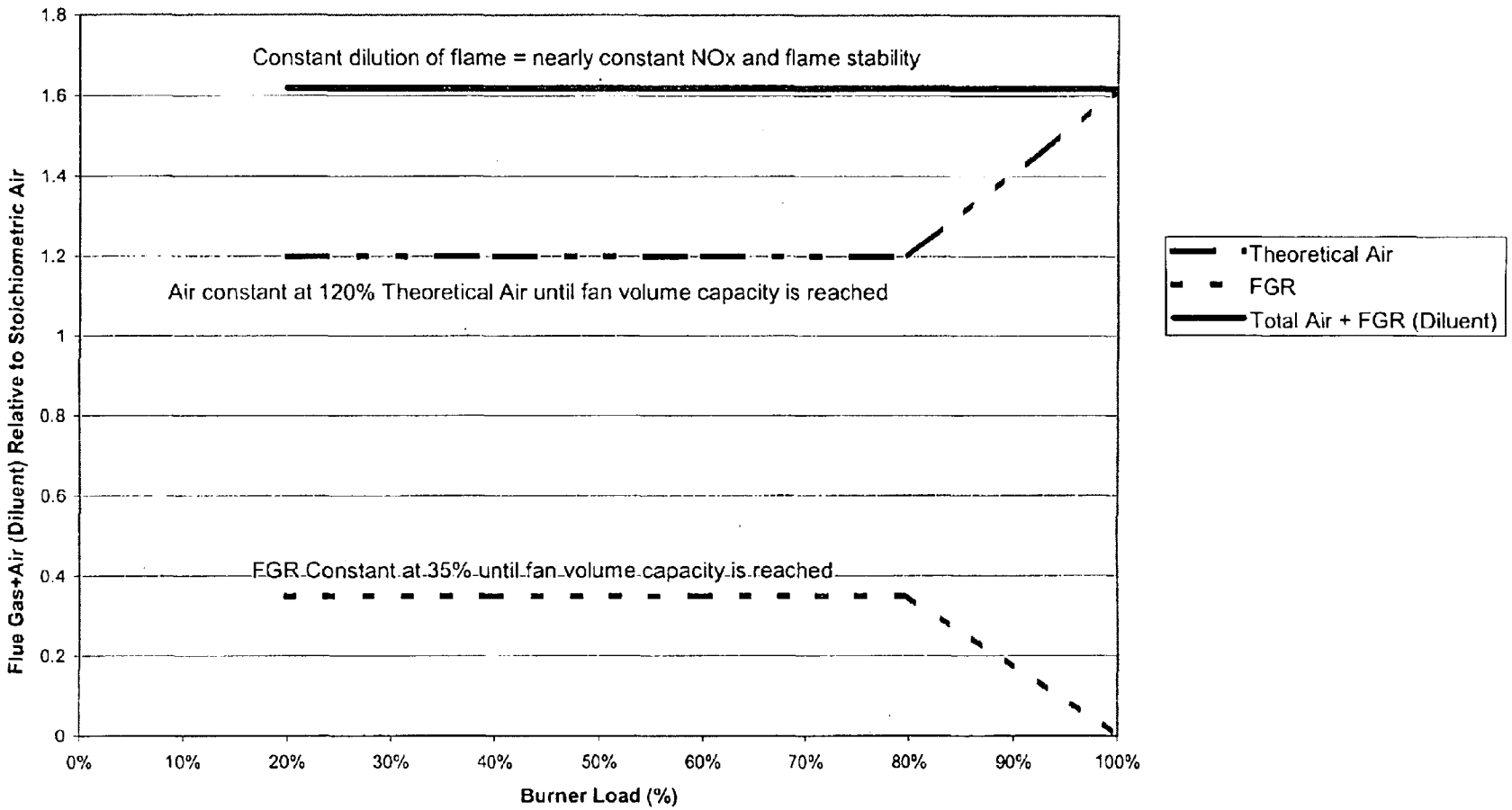

APPARATUS AND METHOD OF OPERATION FOR BURNERS THAT USE FLUE GAS RECIRCULATION (FGR)

BACKGROUND OF THE INVENTION

1. Field of the Invention

The present invention concerns an improved method of operating burners that use flue gas recirculation (FGR). The improved method measures changes in air and air-flue gas mixture temperatures to estimate density variations, and then uses this information to optimize the performance of a combustion air fan over a range of air and recirculated flue gas mixture ratios and temperature ranges. The method can be applied to any burner that uses FGR, as long as the amount of flue gas that is used can be varied at some or all operating conditions without extinguishing the flame. Advantages of this technique are smaller fan size with associated lower first cost for a given maximum burner thermal capacity, reduced electrical power usage over the full range of burner operation, and a lower peak power requirement at a maximum burner capacity.

2. Description of Related Art

Over the past 30 years, the cost of owning and operating combustion equipment, e.g. boilers, has increased due to more stringent environmental regulations and, more recently, due to higher electricity prices. One impact of environmental regulations has been the requirement to use ultra-low $NO_x$ burners (hereinafter ULNBs) to achieve sub-9 ppm $NO_x$ emissions requirements. While the best ULNBs can match the thermal efficiency of standard burners, electric power usage is typically higher. Conventional ULNBs now often require over twice the fan power that was required of previous generation 30-ppm low $NO_x$ burners (hereafter LNBs).

Most fans used in industrial boilers and process heaters are constant speed fans, and a constant speed fan moves air at a fixed maximum volumetric flow rate. As air density changes, the mass flow of air changes while the volumetric flow stays the same.

Power consumption of a combustion air fan is proportional to the pressure rise created by the blower multiplied by the volumetric flow rate. With pressure rise measured in units of $lb_f/ft^2$ and flow measured in units of $ft^3/sec$ it is apparent that the product of these two numbers has units of $lb_f$-ft/sec, which are units of power.

$$\text{Power} \propto \Delta P \cdot Q \tag{1}$$

In a fixed boiler and burner geometry, the pressure requirements of the combustion air fan will vary in proportion to the product of density and the square of the velocity. Therefore, if density remains constant the pressure drop will increase with the square of an increase in mass flow.

$$\Delta P \propto \rho u^2 \tag{2}$$

If mass flow remains constant and density changes, then $\dot{m} \propto \rho u$ remains constant, and pressure will change linearly with the inverse of density.

$$\Delta P \propto \frac{\dot{m}^2}{\rho} \text{ (fixed geometry)}$$

Volumetric flow will change linearly with mass flow if density is constant, and linearly with specific volume (inverse of density) if mass flow is constant.

$$Q = \frac{\dot{m}}{\rho}$$

Increasing mass flow at constant air density therefore increases fan power requirements in proportion to the mass flow ratio raised to the third power.

$$\text{Power} \propto \frac{m^3}{\rho^2} \text{ (fixed geometry) by equations (1), (3), and (4)}$$

For a fixed mass flow, decreasing air density by increasing the temperature (for example by replacing cool ambient air with the equivalent mass of warm flue gas) will increase fan power requirements in proportion the square of the specific volume change, equation (5). Lower density air uses more fan power for a fixed mass flow.

While the fan behaves as a constant volume device, the burner is not. At a fixed heat input, a burner is more accurately described as a constant mass flow device. In order to maintain a fixed fuel-air ratio (or fixed "dilution level") at a fixed fuel flow, a constant mass flow of air is required, not a constant volume flow. Many ULNB's require that a nearly constant "dilution level" be maintained in order to maintain a given $NO_x$ emissions level.

Combustion systems use excess air to ensure complete combustion of the fuel, and importantly in some burners, to lower the combustion temperature to minimize $NO_x$ formation. Excess air is conventionally defined as the amount of air that is in excess of the stoichiometric requirement of the fuel with which it is mixed. Good practice calls for an excess air level of 15% or greater. For burners operating at 9 ppm (parts per million on a volumetric basis) or lower $NO_x$ emissions, the excess air level may be 65% or higher. Most of the excess air serves to lower the combustion temperature and hence its oxygen content acts as an inert like nitrogen to lower combustion temperature.

Flue gas is warmer than air, and it is thermally more efficient to recirculate some flue gas in place of some of the excess air in high-excess-air burners. This can be done as long as the oxygen-depleted flue gas is not mixed with air in a proportion that makes the mixture have insufficient oxygen for complete combustion of the fuel. If flue gas is substituted for an equivalent amount of air on a mass basis, it has been shown that similar burner emissions with be achieved. This is because the primary effect of the addition of either flue gas or excess air to the burner is to quench the flame and to reduce $NO_x$ formation. Therefore, controlling the "total dilution" of the burner, where "total dilution" is defined as the total mass flow of air and flue gas in excess of stoichiometric air, can be an effective way of controlling emissions.

From the above summary, it is seen that increasing mass flow and increasing the temperature of the mass flowing through a burner will increase the power required to achieve a specific firing rate at a fixed fuel-air or dilution level. Large increases in mass flow associated with ULNBs utilizing FGR have had a significant detrimental impact on fan power requirements as will be show below.

Power requirements of burners with different $NO_x$ emissions, different FGR levels, and different dilution levels are discussed in the following paragraphs and summarized in Table 1. To put the issue of fan power into perspective, one starts with an uncontrolled gas-fired burner with about 100 ppm $NO_x$ emissions, before evaluating a typical 30 ppm burner and then lastly two different 9 ppm ULNBs.

A standard natural gas fired burner with uncontrolled $NO_x$ emissions is designed for optimum performance at about 15% excess combustion air. When installed in a standard industrial boiler, a 100 MMBtu/hr burner operating at 15% excess air with 100 ppm $NO_x$ emissions would require approximately a 50 hp fan, or 0.5 fan hp per MMBtu/hr of boiler capacity.

In the late 1980's and early 1990's, 30 ppm $NO_x$ regulations were introduced, and the method of choice for achieving this emissions level was to add typically 15% FGR to a burner operating at 15% excess combustion air. Burners that operate at these, or similar, FGR and excess air levels have now been in widespread use for over 20 years. While this approach has proven to be a good method of achieving 30 ppm emissions, larger combustion air fans and fan motors were required. The combined mass flow of air and flue gas was increased by 15% (with the addition of 15% FGR to the air). In addition the volumetric flow of gas through the fan and burner was increased due to the decrease in density. With 15% FGR, the temperature increase was on the order of 40° F., which corresponds to a density decrease of 8%. Fan power requirements increased by $1.15^3/0.92^2$ (equation 5) or a factor of 1.80. Where a 50 hp fan worked for a 100 ppm burner, now the end user needed about 90 hp (0.90 fan hp per MMBtu/hr of capacity).

More recently, 9 ppm and lower emissions regulations have been introduced for natural gas fired burners in boilers and process heaters. Alzeta Corp. of Santa Clara, Calif. sells a burner for use in food processing and other industries that utilizes only excess combustion air (no FGR) to achieve the flame dilution necessary for 9-ppm $NO_x$ emissions. A dilution level of 60% on a mass basis is required, but since no FGR is used, there is no change in the density of the flow through the fan and burner. This 60% dilution represents a 40% increase in mass flow relative to the baseline burner with 15% dilution. Fan power requirements are therefore increased by $1.4^3$ (equation 5) compared to the uncontrolled baseline, or a factor of 2.74. To achieve 9 ppm $NO_x$ in a 100 MMBtu/hr boiler, the end user would require about 137 hp (1.37 hp per MMBtu/hr of capacity). One disadvantage of the high excess air approach is that thermal efficiency of the boiler is reduced relative to a boiler that uses FGR.

When FGR is used to reach the 9 ppm emissions level, the typical ULNB uses about 35% FGR, 20% excess air, and a total increase in mass flow of about 40% (Equivalent mass flow to what is required by the high excess air burner). FGR increases the volumetric flow of gas through the fan and burner due to the high "mix temperature" of the 35% FGR in ambient air. Assuming a stack temperature of 500° F., the mixed temperature of a 35% FGR flow in 60° F. air is 175° F., which causes an 18% decrease in density relative to air at standard conditions. Fan power requirements increase by $1.4^3/0.82^2$ (eqn 5) or a factor of 4.08. Where a 50 hp fan was sufficient for the uncontrolled baseline, now a 204 hp fan is required. (2.04 fan hp per MMBtu/hr capacity). This huge increase in fan power requirements has been documented at many facilities throughout the nation.

TABLE 1

COMPARISON OF FAN POWER REQUIRED FOR BOILERS WITH DIFFERENT $NO_x$ EMISSIONS

| $NO_x$ Level (ppm) | Relative Mass Flow | Relative Volume (Inverse of Density) | Relative Fan Power | Fan hp for 100 MMBtu/hr Burner |
|---|---|---|---|---|
| 100 | 1.0 | 1.0 | 1 | 50 |
| 30 | 1.15 | 1.09 | 1.8 | 90 |
| 9 (w/ Exc. Air) | 1.4 | 1.0 | 2.74 | 137 |
| 9 (w/ FGR) | 1.4 | 1.22 | 4.08 | 204 |

This growth in fan power requirements to meet lower emissions levels has had a number of adverse effects on end users. These adverse effects include increased capital costs and higher operating costs.

One method of reducing fan power requirements is to use a variable frequency drive (VFD) instead of a constant speed fan. VFD systems have higher capital cost, require more sophisticated burner controls, and are therefore used much less often than constant speed fans in industrial boilers and heaters. End users choosing to use a VFD could benefit from this invention, but to a lesser degree than users of constant speed fans. This invention when used with a VFD would allow the use of a smaller fan housing and would provide increased thermal turndown.

Another method of reducing fan power is to use a 30-ppm LNB and then use stack treatment technology to reduce $NO_x$ emissions to the 9-ppm level. This approach has been shown to have much higher capital cost than the ULNB systems in almost all cases. Therefore, the use of stack treatment technologies with industrial boilers is extremely rare. As with the VFD example described above, the stack treatment system, if preferred, could benefit from the use of the present invention to improve performance of a 30-ppm burner as long as the 30-ppm burner used FGR.

Currently, many well known manufacturers of ULNBs are operating at similar levels of total dilution. These commercial manufacturers include Alzeta, of Santa Clara, Calif.; Todd Combustion (a John Zink Company) of Tulsa, Okla.; and COEN of Burlingame, Calif. Since the fundamental principal involved in reducing $NO_x$ is to quench the flame, it is not surprising that similar total dilution levels are required. The nominal air and flue gas flows that are required are 20% excess combustion air and 35% FGR to achieve 9 ppm emissions. This total flow is typically moved through a single large combustion air fan. Currently only the inventors have recognized the improvement as described below for the present invention.

Art of interest in this technology includes but is not limited to the following:

P. K. Nelson et al., U.S. Pat. No. 4,659,305, assigned to AquaChem., Inc., describes a flue gas recirculation system for fire tube boilers and burners.

R. E. Lofton et al., U.S. Pat. No. 5,040,470, assigned to Shell Western E & P, Inc., describes a steam generation system with $NO_x$ reduction.

E. L. Berger et al., U.S. Pat. No. 6,247,917, assigned to Texaco, Inc., discloses a flue gas recirculation system.

J. D. Sullivan, et al. in U.S. patent application Ser. No. 10/423,680 filed Apr. 25, 2003 discloses a temperature compensated combustion control.

J. D. Sullivan, et al. in U.S. patent application Ser. No. 10/424,047 filed Apr. 25, 2003 discloses a method of combustion control with temperature compensation.

However, none of these cited references individually or in combination in any fashion teach or suggest the present invention.

All patents, patent applications, articles, references, standards, components, supplies and the like cited herein are incorporated herein by reference in their entirety.

From the above description, it is apparent that a need exists for an apparatus and method for cost effectively reducing the fan size and power requirements of burners that use FGR.

SUMMARY OF THE INVENTION

The present invention may use previous inventions of the inventors that accurately control the mass flow of a diluent stream over a broad range of diluent temperature. Having the ability to control diluent flow on a mass flow basis allows for the proper operation of this invention. This invention improves the operation of the burner by making more effective use of the combustion air fan over the full range of burner operation. More specifically, the invention is a burner that operates with a lower temperature oxidizer stream at high mass flow conditions to provide a system that has less overall variation in volumetric flow and fan power requirements over the full burner operating range.

This improvement is achieved by using this invention to improve the utilization of flow and power characteristics of a combustion air fan over the full range of burner operation. More specifically, a method of operation is described that uses a high recirculated flue gas-to-air ratio over most of the boiler operating range to maximize thermal efficiency, but which switches to a lower ratio of flue-gas-to-air, or no flue gas in the limiting case, at the high end of the mass flow range of the burner to minimize the size of the fan housing and fan motor and power requirements. When applied to current generation ULNBs, fan size and power consumption of the fan can be reduced by about 25% without adversely affecting overall $NO_x$ emissions.

If the percentage of flue gas relative to fresh combustion air is increased from 35% to 50% to achieve lower $NO_x$ emissions or higher thermal efficiency, then the reduction in power due to the benefits of this invention could be 35% or higher. Similarly, if the temperature of the flue gas was higher than 500° F. assumed as a typical condition in this analysis, then the power savings would also be greater than 25% and would increase with increasing stack temperature.

In one aspect, the present invention concerns an improved method which increases the operating range of a combustion burner that controls the ratio of recirculated flue gas to air in a flue gas-air oxidizer stream which method comprises:

contacting the combustion generator with fuel and full excess air, recirculated flue gas, and combinations thereof wherein the modulation and control of the flue gas-air ratio is useful to reduce the size of at least one fan in the recirculated flue gas line, one fan in the air line or combinations thereof and results in reducing the power requirements of at least one fan and reduces the emission of nitrogen oxides.

In another embodiment, the present invention is an improved method for operating gas, liquid or solid fuel combustion burners or combinations thereof that utilizes recirculated flue gas, (full) excess air and combinations thereof which method increases the operating range of the burner by operating from a high recirculated flue gas percentage at lower heat input to a lower recirculated flue gas percentage at high heat input to minimize the change in oxidizer volumetric flow relative to change in the oxidizer mass flow, which method comprises (with reference numbers keyed to FIGS. 1, 2, 2A, 2B and 2C):

a. contacting a combustion generator (or burner) (3) with a combustible fuel (4A), wherein said combustion generator is located within a combustion chamber (3A);

b. utilizing an air inlet (10) to provide excess air (10A) to the combustion generator (3);

c. utilizing an exhaust stack (3Q) for exhausting flue gas from the combustion chamber (3A) wherein said exhaust stack has a stack inlet coupled to the combustion chamber (3A) and a take-off point;

d. utilizing a recirculation inlet (3T) and a recirculation outlet (11) for flue gas (11A) wherein said recirculation inlet (3T) is coupled to said take-off point;

e. combining in a mixing zone (10B), recirculated flue gas (11A), air (10A), and combinations thereof for transport of recirculated flue gas and air through the burner; and f. contacting the combustion generator with fuel and recirculated flue gas-air mixtures including up to 100% air, wherein the modulation control between recirculated flue gas-air and excess air mixtures have flow control means (7) for controlling the oxidizer flow between the recirculated flue gas and excess air ratio during operation to result in a mass of diluent which is provided to the said combustion chamber that results in the reduced fan size about 50% or less of conventional and the operational electrical power needed for the at least one fan is about 50% or less of a comparable fan for a conventional combustion system.

In another embodiment in step e the mixing zone is selected from:

(i) a common fan (71) having a recirculated flue gas inlet (72), an air inlet (73) and an outlet (74) to the combustion chamber (3);

(ii) a chamber (81) having a flue gas recirculation line (82) which contains at least one fan (82A) and a separate air line (83) which contains at least one fan (83A) and an outlet line (84); or (iii) an air line (93) which includes at least one fan (93A) connected to the combustion chamber (3) and a flue gas recirculation line (92) which includes an optional fan (92A) having a fuel line (95) immediately downstream of the optional fan (92A) which line (96) exits to the combustion chamber (3).

In a preferred embodiment, in step f the control of the recirculated flue gas-air ratio utilizes an adjustable damper or an on-off damper in the flue gas recirculation line.

In a preferred embodiment, in step e the at least one fan is selected from the group consisting constant speed, variable frequency drive and combinations thereof.

In a preferred embodiment, in step e the means for flue gas-air ratio control is selected from manual, electrical motor, or electro-pneumatic modulation.

In a preferred embodiment, in step e the means for modulation control is analog or digital control modulation.

In one preferred embodiment, in step a the combustion generator uses gas, liquid or solid fuel.

In a preferred embodiment, in step a the combustion fuel is natural gas and in step e the means for modulation of recirculated flue gas-air ratio is digital control and the level of nitrogen oxides emitted is about 9 ppm or less.

In a preferred embodiment, in step e the means for control is selected from an adjustable damper, an on-off damper, a transfer fan, or combinations thereof, and the level of nitrogen oxides emitted is less than about 9 ppm.

In a preferred embodiment, in step a the fuel is natural gas, in step c a fan in each line is present as described in subpart (ii), and the air-recirculated flue gas ratio modulation utilizes analog or digital control.

In another aspect, the present invention concerns an apparatus for a gas, liquid, solid fuel combustion burner or combinations thereof that controls the ratio of flue gas to air in a flue gas-air oxidizer stream during operation which is useful to reduce the size of at least one fan in the flue gas recirculation line, air line or combinations thereof and reduce the power consumption of at least one fan in the flue gas recirculation line, air line or combinations thereof which concurrently increases the operating range of the apparatus.

In a preferred embodiment, the present invention concerns an apparatus for operating gas, liquid, solid fuel combustion burners or combinations thereof that utilizes recirculated flue gas, excess air and combinations thereof which apparatus increases the operating range of the burner by operating from a high recirculated flue gas percentage at lower heat input to a lower recirculated flue gas percentage at high heat input to minimize the change in oxidizer volumetric flow relative to change in the oxidizer mass flow, which apparatus comprises:

A. a combustion generator (3) located within a combustion chamber (3A or 3R), B. an exhaust stack (3Q) for exhausting flue gas (11A) from the combustion chamber (3) wherein said exhaust stack (3Q) has a stack inlet coupled to said combustion generator and a take-off point (3T), C. a recirculation inlet (3T) and a recirculation outlet (11B) wherein for flue gas said recirculation inlet is coupled to said take-off point (3T), D. a separate air inlet (10) to provide excess air (10A) to said combustion generator (3) for transport of recirculated flue gas and air through duct (10D) the burner (3);

E. a mixing zone (10B or 10D or 71A or 81) for combining flue gas (11A), air (10A), and combinations thereof;

F. means within the flue gas recirculation line for modulation control (12 and 13 or 12 and 11) between recirculated flue gas (11A) and excess air (10A) to result in reduced fan size of about 50% or less and in operational electrical power of about 50% or less than the conventional for the at least one fan needed for full excess air.

In another embodiment, the present invention includes in component E a mixing zone selected from:

(i) the mixing zone (71A) is a fan chamber (71) including a mixing fan said chamber has a recirculated flue gas inlet (72), an air inlet (73) and an outlet (74) to the combustion chamber (3), (ii) the mixing zone (81) has a recirculated flue gas inlet line (82) which contains at least one fan (82A), an air line (83) which contains at least one fan (83A) and an outlet line (84) to the combustion chamber (3), or (iii) the mixing zone includes an air line (93) which includes at least one fan (93A) and connects to the combustion chamber (3), and a flue gas recirculation line (92) which includes an optional fan (92A) having the fuel line (95) immediately downstream of the fan (92A), having an exit line (96) to the combustion chamber (3).

In another embodiment, the present invention concerns an improved method for operating gas, liquid, or solid fuel burners that utilizes recirculated flue gas-air and excess air mixtures which method increases the operating range of the burner by operating from a high recirculated flue gas percentage at lower heat input to a lower recirculated flue gas percentage at high heat input under conditions to minimize the change in oxidizer volumetric flow relative to change in the oxidizer mass flow, which method comprises:

a. contacting a combustion generator with a combustible fuel, wherein said combustion generator is located within a combustion chamber;

b. utilizing an air inlet to provide up to full excess air to said combustion generator;

c. utilizing an exhaust stack for exhausting flue gas from the combustion chamber wherein said exhaust stack has a stack inlet coupled to the combustion generator and a take-off point and;

d. utilizing a recirculation inlet and a recirculation outlet for recirculated flue gas wherein for said recirculation inlet is coupled to said take-off point; and e. contacting the combustion generator with excess air and recirculated flue gas-air mixtures, wherein said switching between full excess air and recirculated flue gas-air mixtures to result in a mass of air which is provided to the said combustion chamber and a results in a reduced fan size of about 50% from conventional and reduced electrical power needed for fans to provide full excess air or recirculated flue gas is about 50% or less of comparable conventional combustion systems.

An embodiment of this method wherein the means for control of the flue gas-air ratio is selected from an adjustable damper, an on-off damper, digital control, analog control or combinations thereof.

The other embodiments listed above for the apparatus are incorporated by reference here for the method.

BRIEF DESCRIPTION OF THE FIGURES

FIG. 3 is a comparison of power requirements of 60 and 100 hp fans at similar operating conditions over a typical burner operating range.

FIG. 4 is a comparison of performance of fan and motor combinations for burners operating with and without FGR.

FIG. 5 is a graphic representation of the fan power consumption of the invention compared to the current state of the art.

FIG. 6 is a graphic representation of the typical operating limits of LNBs and ULNBs as a function of total dilution, where dilution is the sum of combustion air and flue gas.

FIG. 7 is a graphic representation of typical flow rates of air and flue gas relative to fuel flow that are used by the invention. Controlling air and flue gas flows in this manner provides benefits that are not apparent to one of skill in this art.

DETAILED DESCRIPTION OF THE INVENTION AND PREFERRED EMBODIMENTS

Definitions

"Diluent" refers to mixtures of flue gas and air.

"FGR" refers to flue gas recirculation.

"Fully metered" or "fully metered system" includes but is not limited to control systems that utilize flow controls, flow measurement, and feedback from the measurement device to the control device for multiple flow lines.

"LNB" refers to low-$NO_x$ burner. Typically a LNB will emit less than 30 ppm $NO_x$(corrected to 3% $O_2$).

"MMBtu/hr" refers to million Btu/hr, 1,000,000 British thermal units per hour.

Figure 1:
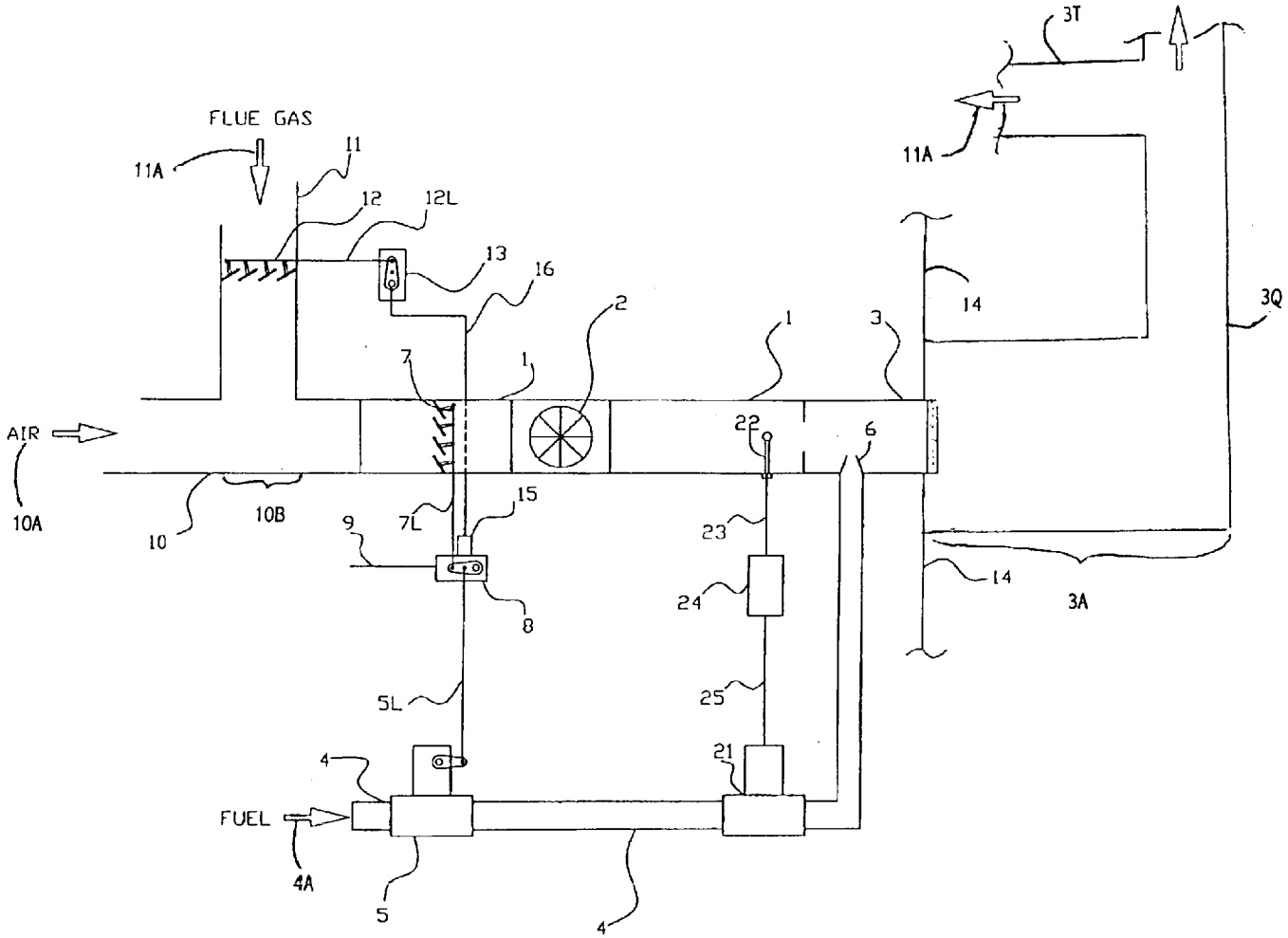
FIG. 1 is a schematic representation of the convention (prior art) "single-point" positioning control system as improved by U.S. Ser. No. 10/423,680 and further improved by the present invention.

"Single point" or "jack shaft" as a positioning system is described for FIG. 1 and in U.S. Ser. No. 10/423,680.

"Optional" refers to the conventional definition and a step or component that may or may not be present and either way describes part of the invention.

"Oxidizer" refers to any gas containing oxygen which enters the combustion chamber.

"ppm" refers to parts per million of one gas in a total gas stream, and is usually assumed to be on a volumetric basis.

"Parallel positioning" as a system is described in U.S. Ser. No. 10/423,680.

"ULNB" refers to ultra-low $NO_x$ burner. This is typically a burner with emissions of $NO_x$ of 9-ppm or less (corrected to 3% $O_2$).

The present invention is described with reference to the above figures as follows:

FIG. 1 shows a combustion control system comprising an air and flue gas supply duct 1 with blower 2 feeding burner (fan) 3. Fresh combustion air is supplied to the blower by inlet 10 and flue gas from the burner is supplied to the blower by inlet 11. Fuel supply line 4 with control valve 5 discharges fuel through nozzles 6 into burner 3 to form a uniform fuel-air mixture before exiting burner 3 and undergoing combustion. Partial line 14 represents a wall of a furnace into which burner 3 discharges the burning mixture. The flow of air and flue gas to blower 2 is regulated by damper 7 which is moved by mechanical linkage 7L to mechanical actuator 8 that responds to firing rate signals received through line 9. Valve 5 is also operated by mechanical linkage 5L connected to actuator 8. The ratio of flue gas to air is held nearly constant at a selected level by the positioning of the FGR damper 12 in a defined "full-open" position that allows for example 35% FGR This system, as thus far described, is essentially the common "jack-shaft" or "single-point" positioning system.

The invention as disclosed in application U.S. Ser. No. 10/423,680 and as shown in FIG. 1 is able to compensate for temperature (and density) variations of the air and flue gas mixture that can result from changes in the ambient air temperature, changes in the flue gas temperature, and most importantly in this case, changes in the ratio of flue gas to ambient air. Although not part of the current invention, the previously disclosed invention can simplify the operation of the current invention. application Ser. No. 10/423,680 describes the operation of electrically operated valve 21 in series with supply line 4 and valve 5. Temperature sensor 22 in duct 1 near burner 3 passes temperature signals through line 23 to converter 34 that through line 25 electrically controls the operation of valve 21. The hardware 21–25 adjusts the flow of fuel to match the total mass flow of air and flue gas (the diluent flow) to the fuel flow in order to maintain a constant dilution level, and therefore nearly constant $NO_x$ with stable flame properties, over a wide range of diluent temperature.

When a means of blocking the flow of flue gas at the high end of the operating range of the burner is installed, then the present invention can be used. Flue gas flow is controlled by damper 12, moved by linkage 12L connected to actuator 13. During low to medium fuel flow conditions, the damper 12 will be in its previously defined "full open" position and will be adding nominally 35% FGR to the fresh combustion air stream. When actuator 8 reaches its full open position, it will actuate a limit switch 15. Limit switch 15 will close a circuit, which will activate actuator 13. Actuator 13 will drive damper 12 to the full closed position, shutting off the flow of flue gas, reducing the temperature of the air-flue gas stream to the ambient air temperature, and thereby increasing the mass flow of diluent to burner 3. Temperature sensor 22, control valve 21, and related hardware will increase fuel flow automatically to compensate for the increased mass flow of diluent.

When the firing rate signal through line 9 directs actuator 8 to reduce firing rate, the actuator will begin to close, limit switch 15 will no longer by made, and actuator 13 will return damper 12 to the "full open" position. This will decrease the total mass flow of diluent through the burner, and temperature sensor 22, control valve 21, and related hardware will reduce fuel flow automatically to compensate for the decreased mass flow of diluent. The presence of limit switch 15, signal line 16, actuator 13, damper 12, and damper arm 12L increases the mass flow operating range of the given system.

Figure 2:
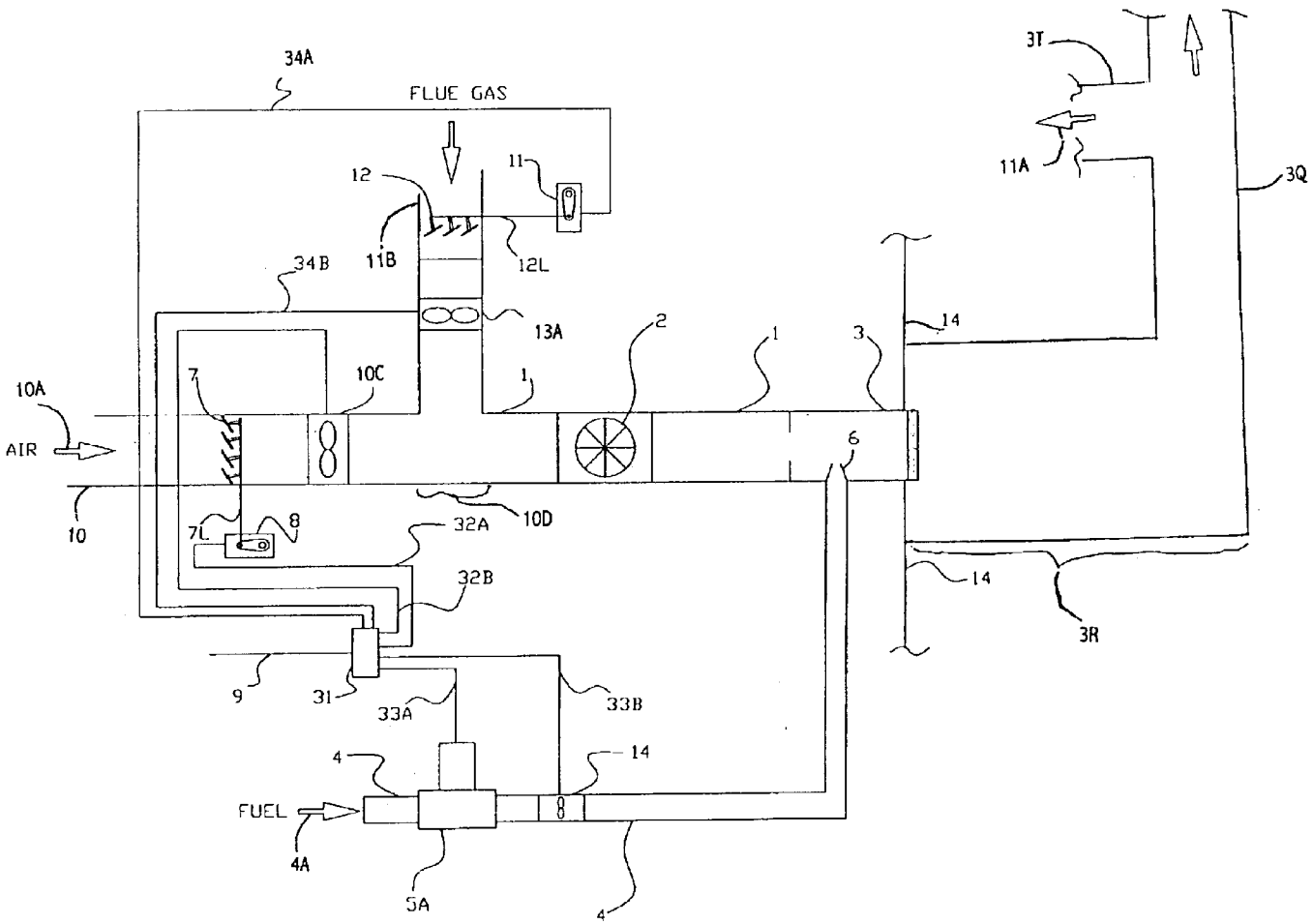
FIG. 2 is a schematic representation of a fully metered control system as improved by the present invention.
Figure 2C:
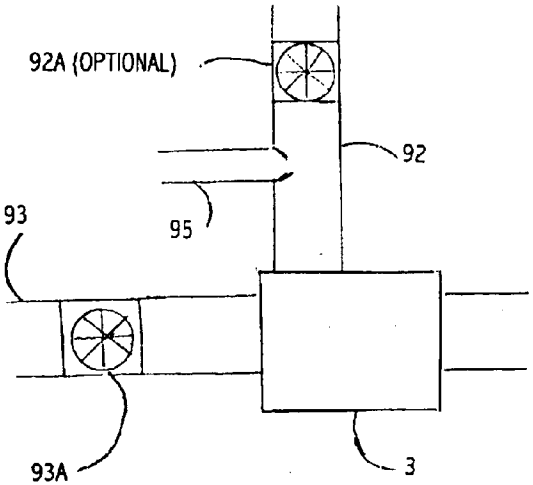
FIG. 2C is a schematic representation of a mixing embodiment described in the SUMMARY as E (iii).
Figure 2B:
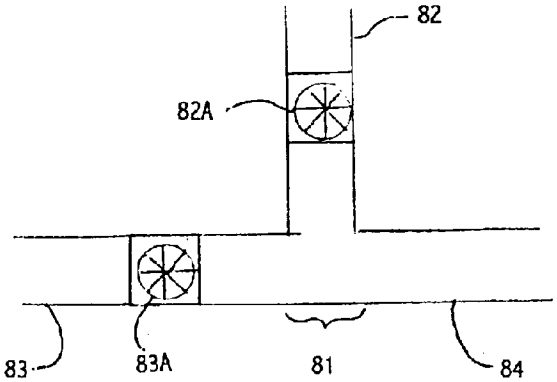
FIG. 2B is a schematic representation of a mixing embodiment described in the SUMMARY as E (ii).
Figure 2A:
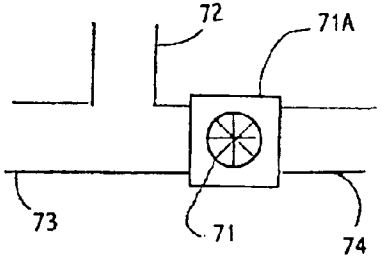
FIG. 2A is a schematic representation of one mixing embodiment described in the SUMMARY as E (i).

FIG. 2 shows a combustion control system comprising an air and flue gas supply duct 1 with blower 2 feeding burner 3. Fresh combustion air is supplied to the blower by inlet 10 and flue gas (11A) from the burner (3) is supplied to the blower by inlet 11. Fuel supply line 4 with control valve 5 discharges fuel (4A) through nozzles 6 into burner 3 to form a uniform fuel-air-flue gas mixture before exiting burner 3 and undergoing combustion. Partial line 14 represents a wall of a furnace into which burner 3 discharges the burner mixture. The total flow of air to blower(fan) 2 is controlled by damper 7 which is controlled through linkage 7L by actuator 8, with a feedback flow signal (line 32B) provided to a digital control system by flow meter 10C. Similarly, recirculation flue gas flow is controlled by actuator 11 (and line 34A) acting on damper 12 through linkage 12L. A feedback signal (line 34B) proportional to flue gas flow is provided by flow meter 13A. Similarly, fuel flow is controlled and metered by control valve 5A and flow meter 14 (via line 33B).

Three pairs of control and feedback signals (fuel, line 33A, 33B; air, line 32A, 32B; flue gas, line 34A, 34B) are connected to the digital controller 31 that adjusts the three mass flows to provide the proper ratios of the three streams at any given load condition. The desired load condition is provided to the digital controller 31 by signal line 9. This control scheme represents a simplified, but reasonably accurate description of what is commonly referred to as a fully metered combustion control system. In a standard implementation of fully metered controls with FGR, the air, fuel, and FGR flows are controlled to maintain a high level of FGR through most of the load range, and specifically maximum load. With the current invention, the following would occur:

a) Maximum FGR (35% for example) would be utilized from minimum burner heat input to the point where combustion air fan 2 was moving diluent at maximum volumetric capacity of the fan. This would occur at about 80–85% of maximum mass flow of ambient air through the fan.

b) From this point on the burner load curve to 100% burner load, a signal for increased heat input through line 9 to digital controller 31 would result in adjustment of the flow controls to decrease the mass flow of flue gas, increase by a greater amount the mass flow of combustion air, and increase the flow of fuel. Adjustment of the flow of air, flue gas, and fuel would be done in a modulating manner, as opposed to the on-off flue gas control shown in FIG. 1. The decrease in the mass flow of flue gas and greater increase in the flow of fresh combustion air, would be balanced by digital controller 31 to maintain constant volumetric flow through the fan. Since the fully metered control system can control the mass flows of fuel, air, and flue gas, no additional flow compensation is required beyond what is provided by the fully metered system.

c) In transitioning from high heat input back to lower heat input, the percentage of FGR in the diluent stream on a mass basis would be gradually increased.

At the point where the FGR level reached the maximum desired level (35% for example), then the mass ratio of FGR to air would be held constant over the rest of the operating range to maximize thermal efficiency.

In the case of the fully metered system in FIG. 2, mass flows of recirculated flue gas, air and fuel can be defined based on a predetermined set of operating conditions. The metering and feedback of flow rate signals, provides the control necessary to achieve the desired increase in the operating range of the combustion air fan.

The invention is designed and operates as follows:

1) The combustion air fan has been sized to provide the mass flow of ambient air necessary to achieve ULNB performance at maximum boiler capacity. When compared to a system providing the same mass flow, but with 35% FGR, the Alzeta fan body will be 18% smaller and will have a motor that is up to 35% smaller.

2) At conditions below peak load, from minimum heat input to 82% of peak, the system will operate at the 35% FGR condition that maximizes thermal efficiency. The combustion air fan has sufficient volumetric capacity to operate with 35% FGR up to that load condition, at which point the volumetric capacity of the fan (but not the mass flow capacity) has been reached. Thermal efficiency is matched using significantly less power since, as shown in FIG. 3, a larger motor will use more electricity then a small motor at all flow conditions that can be achieved by both fans.

3) Because the fan operates with lower density (higher specific volume) air at minimum fire, and with higher density air at maximum fire, the mass flow range of the blower is greater than the volumetric flow range. Since burner operation is proportional to mass flow, the operating range of the burner (burner turndown) is increased for a given fan design. Although this may appear to be a minor detail, this increased turndown can significantly reduces burner operating costs.

4) Operationally the burner is designed so that 35% FGR is blended with air from minimum fire to 82% load. Between the 82% load and 100% load conditions, the flue gas flow is gradually reduced and ambient combustion air is substituted in its place. This maintains constant volumetric flow while linearly increasing mass flow.

5) Since the mass flow change between 82% and 100% load will occur with no adjustment to the fan air dampers, the fuel flow must be de-coupled from air damper control at the high load conditions. This is accomplished using previously demonstrated Alzeta fuel control designs that sense the temperature of the air-flue gas mixture and use this data to adjust fuel flow to match the change in the air-plus-FGR stream. This fuel control design is proven and is used on Alzeta's standard FGR systems. Alternatively a fully metered control system is programmed to maintain the desired fuel, air and recirculated flue gas mass flows over the full range of operation.

6) Standard engineering practice in sizing fans is to add 10% to the required flow rate, and 21% to required static pressure, to ensure that there is some "margin" above the maximum operating condition. Therefore, if a fan has been sized correctly, the fan will operate in the high efficiency FGR mode of operation for all but the top 8% of the load range (with the final 10% of high excess air operation representing additional operating range beyond nameplate burner capacity). High excess air operation from 82% to 100% of load therefore represents a worst case scenario,-with the more likely situation being high excess air operation from 92% to 100% load.

The following types of well-known conventional burner control systems benefit from this invention.

1. Single-point positioning, using a single drive motor or actuator and jackshafts or linkages.
2. Parallel positioning, where an independent controller sends signals to separate motors or actuators on a number of control valves that could be as few as two valves and as many as 4 to 5 separate control valves. These systems can also incorporate valve position feedback and cross limiting control between valves.
3. Fully metered systems that use control valves to control flow and meters to measure flows, with all flows controlled by a central processing unit such as a programmable logic controller (PLC) or a PC.
4. Electro-hydraulic actuators such as the Siemens SKP fuel-air ratio controller that control the flow of one fluid (natural gas for example) vs a second fluid (air for example) by maintaining a constant pressure ratio relationship between the two flows. The pressures used for control include pressure drop across orifices or actual pressure at a fixed point in the system relative to atmosphere.

The invention also provides benefit for other types of fuel air ratio control, and which would now be obvious to one skilled in this art.

FIG. 6 is a graphic representation comparing $NO_x$ emission with the total dilution on a mass flow basis. To meet the $NO_x$ requirements of 9 ppm with this invention requires operation in the region 61 in which the flame has been cooled with excess air or recirculated flue gas (diluent) to reduce $NO_x$ emissions, but not the part where combustion becomes unstable and flames out (61A).

FIG. 7 is a graphic representation of typical ratios of air, flue gas, and total dilution relative to stoichiometric air for a ULNB over the full range of burner operation. As can be seen from FIG. 7, over the full range of burner operation the dilution on a mass basis relative to stoichiometric air remains constant (at 1.62 in this case). From approximately 82% burner heat input to 100% input, the percentage of flue gas flow is decreased and the percentage of combustion air flow is increased. On a volumetric basis, for every one cubic foot of flue gas flow reduction, there is a corresponding one cubic foot increase in combustion air flow. Since flue gas is less dense than air, this volumetric substitution of air for flue gas results in an increase in diluent mass flow as the burner modulates from 82% load to 100% load.

In some embodiments of this invention, the fan size reduction observed is up to about 50%, or between about 10 and 50%, between about 10 and 25%, between about 10 and 20% or between about 10 and 15% of the conventional fan size.

In some embodiments, the operating electric power requirements are reduced up to about 50%, or between about 10 and 50%, between about 10 and 25%, between about 10 and 20% or between about 10 and 15% of the conventional power requirements.

In some embodiments, oxygen sensors are excluded from the method and apparatus.

In some embodiments, pressure sensors are excluded from the method and apparatus.

In some embodiments, temperature sensors are excluded from the method and apparatus.

The following examples are provided to be illustrative and explanatory only. They are not to be construed or interpreted as being limiting in any way.

General

The equipment and components described herein are commercially available from local and U.S. companies, e.g. Alzeta, Todd, COEN, etc. The components described herein by brand name can in virtually all configurations can be substituted with available components of the art. One of ordinary skill in this art can select the components and make these substitutions.

EXAMPLE 1

Modulated Operational Switching (a) To help in explaining and quantifying the benefits of this approach, a typical boiler size is selected and a major national supplier of combustion air fans was contacted to provide actual fan performance curves. Although the example shown is therefore specific to one equipment size, the concept and the cost savings, will easily scale across the full range of industrial boilers.

A 63 MMBtu/hr burner Alzeta CSB630 was selected as the basis for quantifying performance. As shown, this burner is close to the average boiler size in the industry (in California, e.g. the San Joaquin Valley), and is representative of a burner required to power a boiler with steam capacity of 50,000 lb/hr. Three sets of performance curves were generated by the fan manufacturer.

Full FGR from minimum heat input to 63 MMBtu/hr capacity, which is the standard FOR design and required 98 bhp Full excess air (60° F. air) from minimum heat input to 63 MMBtu/hr, which is the standard Alzeta high excess air design and required 72 bhp.

Full FGR using the same fan and motor as in case 2, although this case could only achieve 82% of burner thermal capacity with FOR and required 57 bhp.

The actual fan performance curves are available from the manufacturer. Data of interest for this presentation were extracted from those plots and is presented below. FIG. 4 presents fan power usage versus boiler thermal load for the 3 fan cases investigated, and shows the higher power requirements that the larger fan and motor will have over the full range of operation. Notice that the small FGR system has the lowest fan power requirements over most of the operating range, but that it cannot reach thermal capacity.

The data from FIG. 4 were used to extract the information necessary to construct a "hybrid" performance curve with the FGR data used at low flow conditions until maximum volumetric flow was achieved, and then the excess air data were used at the higher flow conditions. The flue gas level was reduced in a linear fashion from a 82% thermal capacity to the 100% thermal capacity point. This curve is compared to the competing baseline in FIG. 5.

Although both fans can reach equivalent thermal capacity, fan power required for the Alzeta system is lower than the standard system over the full operating range, and is typically 20% to 25% lower. Turndown (the minimum flow condition) is improved significantly with this approach (14% of maximum heat input versus 23% of maximum for the standard approach). The increased turndown capability and the reduced power consumption at all load conditions will reduce operating costs. In addition, since the fan and motor are smaller, initial cost will be less.

With lower initial cost, lower electrical power costs, and increased operating range all being benefits, there are some potential negative performance aspects of this system. The main negative impact to this invention is that thermal efficiency will be reduced at the top of the boiler load curve. Thermal efficiency will be equivalent to the current state of the art up to 82% of fan capacity, but from that point on there will be a linear decrease in thermal efficiency when compared to a standard FGR system. The maximum thermal efficiency penalty will be on the order of 2.5%, and will only occur at the peak load condition. If the fan has been properly sized to include a 10% margin, thermal efficiency will be equivalent up to 92% of boiler load, and the maximum thermal efficiency penalty will be about 1%.

When the small thermal efficiency penalty at the top of the load curve is weighed against the benefits of a) lower first cost, b) reduced electric power consumption, and c) increased thermal turndown, the invention will prove to be the most cost effective in almost all cases. In the rare cases where a boiler does operate continuously at maximum load, then the fan and motor should be sized to allow full FOR operation to 100% load. The "hybrid" approach of transitioning to excess air operating would then provide the customer with a low cost 15% "power boost" over nameplate capacity of the fan.

(b) Similarly subpart (a) is repeated, except that the Alzeta burner is replaced by a Todd Combustion RMB™ (Rapid Mix Burner) (a pending trademark of the Todd Combustion Corp. of Tulsa, Okla.). Temperatures and flow rates are similar as is the reduction in fan size and operating fan power usage.

(c) Similarly subpart (a) is repeated, except that the burner is a COEN burner model, microNO$_x$™ (as marked for U.S. Pat. No. 6,027,330) or DELTA NO$^x$™ (a pending trademark of the COEN Co. of Burlingame, Calif.). Temperatures, flow rates, etc. are similar as is the reduction in fan size and operating fan power usage.

EXAMPLE 2

On-off Operational Switching (a) Demonstration of a simpler system that modulates up to the full-FGR flow rate, but then operates in an on-off manner between the excess-air-only and the high-FGR modes was demonstrated experimentally.

In these tests, the Alzeta burner Model CSB84 was operated at nominally 35% FGR and 20% excess air at maximum high-FGR load (observed to be 7.3 MMBtu/hr). With the boiler and burner operating in fully automatic control, a motor-controlled FOR damper was switched to the full-closed position to shut-off FGR flow. As predicted, without recirculated flue gas entering the combustion air fan, the fan responded by moving an equivalent volumetric flow of excess air, and therefore higher mass flow. Alzeta's temperature compensated gas train responded to this change in the temperature of the flow through the combustion air fan.

Fuel flow increased in proportion to the increased mass flow, and the fired duty of the burner increased approximately 16% from 7.3 MMBtu/hr up to 8.5 MMBtu/hr. The burner remained stable throughout the transition, and emissions remained nearly constant at a level below the targeted emissions level of 9 ppm. The reverse transition from lean premix operation to high FGR operation was also accomplished manually and without incident.

(b) Similarly, subpart (a) is repeated except that the Alzeta burner is a COEN burner model microNO$_x$™ or DELTA NO$_x$™ (a trademark of the COEN Co. of Burlingame, Calif.). Temperatures, flow rates, etc. are similar as is the reduction in fan size and operating fan power usage.

While only a few embodiments of the invention have been shown and described herein, it will become apparent to those skilled in the art that various other modifications and changes can be made in the present method to create an apparatus configuration and a method to use flue gas recirculation (FGR), full excess air and combustions thereof reducing electric fan size and operating power requirements and having reduced emissions of nitrogen oxides (NO$_x$) of about 50 ppm, 20 ppm or 10 ppm or less without departing from the spirit and scope of the present interest. All such modifications and changes are intended to be within the scope of the invention and appended claims.

We claim:

1. An improved method which increases the operating range of a combustion burner that controls the ratio of flue gas to air in a flue gas-air oxidizer stream which method comprises:

A. contacting the combustion generator of the combustion burner with fuel and full excess air, recirculated flue gas, and combinations thereof with B. modulating and controlling which results in: the modulation and control of the recirculated flue gas-air ratio is useful in C. reducing the size of at least one fan in the recirculated flue gas line, one fan in the air line or combinations thereof; and D. concurrently resulting in reducing the power requirements of at least one fan and reduces the emission of nitrogen oxides.

2. An improved method for operating gas, liquid or solid fuel combustion burners or combinations thereof that utilizes recirculated flue gas, full excess air and combinations thereof which method increases the operating range of the burner by operating from a high recirculated flue gas percentage at low heat input to a lower recirculated flue gas percentage at high heat input under conditions to minimize the change in oxidizer volumetric flow relative to change in the oxidizer mass flow, which method comprises:

a. contacting a combustion generator with a combustible fuel, wherein said combustion generator is located within a combustion chamber;

b. utilizing an air inlet to provide full excess air to the combustion generator;

c. utilizing an exhaust stack for exhausting flue gas from the combustion chamber wherein said exhaust stack has a stack inlet coupled to the combustion chamber and a take-off point;

d. utilizing a recirculation inlet and a recirculation outlet for flue gas wherein said recirculation inlet is coupled to said take-off point;

e. combining in a mixing zone, recirculated flue gas, air, and combinations thereof for transport of recirculated flue gas and air through the burner;

f. contacting the combustion generator with fuel and recirculated flue gas and air mixtures, wherein the modulation control between the recirculated flue gas and excess air mixtures has flow control means for controlling the oxidizer flow between the recirculated flue gas and excess air ratio during operation to result in a mass of diluent which is provided to the said combustion chamber resulting in the reduced fan size of about 50% or less reduction compared to the conventional fan and the operational electrical power needed for the at least one fan is reduced about 50% or less reduction of a comparable fan for a conventional combustion system.

3. The method of claim 2 wherein in step e the mixing zone is selected from:

(i) a common fan having a flue gas inlet, an air inlet and an outlet to the combustion chamber;

(ii) a chamber having a flue gas recirculation line which contains at least one fan and a separate air line which contains at least one fan and an outlet line; or (iii) an air line which includes at least one fan connected to the combustion chamber and a flue gas recirculation line which includes an optional fan having a fuel line immediately downstream of the optional fan which line exits to the combustion chamber.

4. The method of claim 2 wherein in step f the control of the recirculated flue gas-air ratio utilizes an adjustable damper or an on-off damper in the flue gas recirculation line.

5. The method of claim 2 wherein in step e the at least one fan is selected from the group consisting of constant speed, variable frequency drive and combinations thereof.

6. The method of claim 2 wherein in step e the means for modulation control is selected from manual, electro-pneumatic, digital control or analog control.

7. The method of claim 2 wherein in step e the means for modulation control is digital control modulation and the level of nitrogen oxides is less than about 20 ppm.

8. The method of claim 2 wherein in step a the combustion generator uses gas, liquid or solid fuel.

9. The method of claim 2 wherein in step a the combustion fuel is natural gas and in step c the means for modulation is digital control and the level of nitrogen oxides emitted is about 9 ppm or less.

10. The method of claim 2 wherein in step e the means for control is selected from an adjustable damper, an on-off damper, a transfer fan, or combinations thereof, and the level of nitrogen oxides emitted is less than about 9 ppm.

11. The method of claim 7 wherein in step (a) the fuel is natural gas, in step (c) a fan in each line is present as described in subpart (ii), and the modulation is digital control.

12. An apparatus configuration for a gas, liquid or solid fuel combustion burner or combinations thereof, which apparatus configuration comprises:

a. a combustion generator;

b. an exhaust stack having a stack inlet;

c. a recirculation inlet and a recirculation outlet;

d. a separate air inlet to the combustion generator;

e. a mixing zone and f. means within the flue gas recirculation line for modulating and controlling the ratio of recirculated flue gas and excess air which results in a substantially constant volume flow and higher mass of air and flue gas diluent resulting in a reduced fan size and reduced operational electric power.

13. An apparatus for operating gas, liquid, or solid fuel combustion burners or combinations thereof that utilizes flue gas recirculation, excess air and combinations thereof which apparatus increases the operating range of the burner by operating from a high recirculated flue gas percentage at lower beat input to a lower recirculated flue gas percentage at high heat input under conditions to minimize the change in oxidizer volumetric flow relative to change in the oxidizer mass flow, which apparatus comprises:

A. a combustion generator located within a combustion chamber,

B. an exhaust stack for exhausting flue gas from the combustion chamber wherein said exhaust stack has a stack inlet coupled to said combustion generator and a take-off point, C. a recirculation inlet and a recirculation outlet wherein for flue gas said recirculation inlet is coupled to said take-off point, D. a separate air inlet to provide full excess air to said combustion generator, E. a mixing zone for combining recirculated flue gas, air and combinations thereof for transport of recirculated flue gas and air through the burner; and F. means within the flue gas recirculation line for modulation control between recirculated flue gas and excess air to result in a substantially constant higher mass of air and flue gas diluent at a given fuel flow is provided to said combustion chamber which results in a reduced fan size of about 50% or less reduction and results in a reduction of operational electrical power of about 50% or less reduction than the conventional for the at least one fan needed for full excess air.

14. The apparatus of claim 13 wherein in subpart F the means for control of the recirculated flue gas-air ratio is selected from an adjustable damper, an on-off damper, digital control or combinations thereof.

15. The apparatus of claim 13 wherein in subpart F the at least one fan is selected from the group consisting of constant speed, variable frequency drive (VFD) and combinations thereof.

16. The apparatus of claim 13 wherein in subpart F the means for modulation is selected from electro-pneumatic or digital control.

17. The apparatus of claim 15 wherein in subpart F the means for modulation control is digital control and the level of nitrogen oxides is less than about 30 ppm.

18. The apparatus of claim 13 wherein in subpart F the level of nitrogen oxides is less than about 9 ppm.

19. The apparatus of claim 13 wherein in subpart A the combustion fuel is selected from gas, liquid or solid fuel.

20. The apparatus of claim 15 wherein the combustion fuel is natural gas and the level of nitrogen oxides emitted is less than about 9 ppm.

21. The apparatus of claim 13 wherein in subpart F the means for control of the flue gas-air ratio is selected from an adjustable damper, a transfer fan, or combinations thereof and the level of nitrogen oxides emitted is less than about 9 ppm.

22. The apparatus of claim 13 wherein in subpart E the means for modulation control is E (iii), the fan is not present , and a high pressure fuel gas stream enters the flue gas recirculation line that induces flow of flue gas and the combination exits to the combustion chamber.

23. In a method for operating gas, liquid or solid fuel combustion burners that utilizes flue gas recirculation, full excess air and combinations thereof which method increases the operating range of the burner by operating from a high flue gas recirculation percentage at lower heat input to a lower flue gas recirculation percentage at high heat input under conditions to minimize the change in oxidizer volumetric flow relative to change in the oxidizer mass flow, wherein the improvement comprises:

a. utilizing an adjustable damper or an on-off damper located within the flue gas recirculation line b. utilizing means for modulating said damper, and is which results in the fan size in the oxidizer gas lines being reduced about 50% or less reduction as the operating power requirement is reduced about 50% or less reduction as compared to the conventional fan, or the level of nitrogen oxides emitted is reduced to a level of about 50 ppm or less.

* * * * *